US005187883A

United States Patent [19]

Penney

[11] Patent Number: 5,187,883

[45] Date of Patent: Feb. 23, 1993

[54] INTERNAL FOOTWEAR CONSTRUCTION WITH A REPLACEABLE HEEL CUSHION ELEMENT

[76] Inventor: Richard Penney, 55 W. 16th St., New York, N.Y. 10011

[21] Appl. No.: 565,347

[22] Filed: Aug. 10, 1990

[51] Int. Cl.[5] ..... A43B 13/28

[52] U.S. Cl. ..... 36/35 R; 36/37; 36/27

[58] Field of Search ..... 36/27, 37, 38, 58.6, 36/68, 69, 105, 107, 108, 114, 36 A, 36 C, 76, 92, 102, 35 R, 36 B

[56] References Cited

U.S. PATENT DOCUMENTS

| | | | |
|---|---|---|---|
| 74,912 | 2/1868 | Hadley . | |
| 413,693 | 10/1889 | Walker . | |
| 580,014 | 4/1897 | Mobberley . | |
| 1,114,685 | 10/1914 | Freeman . | |
| 1,853,027 | 4/1932 | Adams | 36/37 |
| 1,973,105 | 9/1934 | Ruhn et al. | 36/35 R |
| 2,222,391 | 11/1940 | Andreasen | 36/28 |
| 2,399,543 | 4/1946 | Dack . | |
| 2,555,654 | 6/1951 | Ostrom . | |
| 2,863,230 | 12/1958 | Cortina | 36/35 R |
| 3,214,849 | 11/1965 | Nadaud . | |
| 4,253,252 | 3/1981 | Eisenberg . | |
| 4,271,606 | 6/1981 | Rudy . | |
| 4,342,158 | 8/1982 | McMahon et al. . | |
| 4,391,048 | 7/1983 | Lutz | 36/28 |
| 4,486,964 | 12/1984 | Rudy . | |
| 4,492,046 | 1/1985 | Kosova . | |
| 4,507,879 | 4/1985 | Dassler . | |
| 4,535,553 | 8/1985 | Derderian et al. . | |
| 4,557,060 | 12/1985 | Kawashima | 36/44 |
| 4,592,153 | 6/1986 | Jacinto . | |
| 4,694,590 | 9/1987 | Greenawalt | 36/91 |
| 4,709,489 | 12/1987 | Welter | 36/27 |
| 4,771,554 | 9/1988 | Hannemann . | |
| 4,794,707 | 1/1989 | Franklin et al. | 36/107 |
| 4,815,221 | 3/1989 | Diaz . | |
| 4,833,795 | 5/1989 | Diaz . | |
| 4,835,884 | 6/1989 | Bianchini et al. | 36/24.5 |
| 4,843,737 | 7/1989 | Vorderer . | |
| 4,878,301 | 11/1989 | Kiyosawa . | |
| 4,881,329 | 11/1989 | Crowley . | |
| 4,887,367 | 12/1989 | Mackness et al. . | |

FOREIGN PATENT DOCUMENTS

| | | |
|---|---|---|
| 2200030A | 7/1988 | United Kingdom . |

*Primary Examiner*—Paul T. Sewell
*Assistant Examiner*—Thomas P. Hilliard
*Attorney, Agent, or Firm*—Hopgood, Calimafde, Kalil, Blaustein & Judlowe

[57] ABSTRACT

An internal footwear construction is generally disclosed comprising a substantially non-yielding platform, a substantially non-yielding support frame, and at least one elastic element. The platform must extend into at least a portion of the heal region and be disposed above the outer sole. The support frame is adjacent to at least one portion of the heel region and the elastic element extends between the platform and the support frame, above the heel region. The elastic element is spatially arranged to permit elongation and contraction between the support frame and platform. Several embodiments are disclosed for a variety of footwear designs and shoe assemblies. A user replaceable elastic element permits selective adaptation for conventional, athletic and recreational applications.

11 Claims, 9 Drawing Sheets

INTERNAL FOOTWEAR CONSTRUCTION WITH A REPLACEABLE HEEL CUSHION ELEMENT

BACKGROUND OF THE INVENTION

1. Field of the Invention

The present invention generally relates to an internal footwear construction and, more particularly, to an elastic element which absorbs energy on impact and returns it to a user's foot, thereby providing a biomechanical advantage to repetitive steps of the human foot.

2. Brief Description of the Prior Art

Numerous prior art designs have attempted to provide a stable footwear construction which absorbs impact energy and returns it to a user's foot. Certain crude techniques involve the use of compressible elements such as springs or plates located in the outer or mid-sole portion of a shoe.

Another prior art technique involves the use of gas encapsulating membranes or chambers provided to the mid-sole for the purpose of absorbing shock on hard surfaces. Other designs require mid-sole and outer sole constructions having predetermined durometric properties, differential cushion layers and air pockets. Use of stationary heel inserts and resilient inner soles have also been proposed to eliminate shock and lateral sway of the foot.

These art-recognized techniques have attempted to provide an optimum combination of comfort, support and shock absorption. Several designs have attempted to reduce impact on walking and running surfaces, prevent pronation and provide biomechanical advantage to the foot. But, the prior art constructions have been generally characterized by unnecessary complexity, high manufacturing costs, rapid failure quotients, unreliability, leakage, deformation and lack of user adaptability.

Accordingly, it is a primary object of the present invention to provide an internal footwear construction which is capable of absorbing energy and returning it to a user's foot.

It is another object of the present invention to provide an internal footwear construction which offers structural support and cushioned comfort for podiatric application.

Another object of the present invention is to provide an internal footwear construction that offers biomechanical advantage by cooperating with the natural articulation and physical functioning of the human foot.

A further object of the present invention is to provide an internal footwear construction that operates in a simple and reliable manner.

Another object of the present invention is to provide an internal footwear construction adaptable for a wide variety of conventional, athletic and recreational (non-athletic) end-use applications.

A further object of the present invention is to provide an internal footwear construction with an interchangeable component selected by the end-user to accommodate a particular physical activity.

A further object of the present invention is to provide several types of athletic footwear which incorporate the internal construction of the present invention.

Based on this disclosure, additional objects of the present invention will be apparent to those with ordinary skill in the pertinent art.

SUMMARY OF THE INVENTION

The present invention is directed to an internal construction for use in footwear which includes an outer sole having a heel region and forefoot region. In general, the internal construction comprises a substantially non-yielding platform, a substantially non-yielding support frame, and at least one elastic element. The platform extends into at least a portion of the heel region and is disposed above the outer sole. The support frame is adjacent to at least one portion of the heel region and the elastic element extends between the platform and support frame in a spatial relationship which permits elongation and contraction in the loaded and unloaded condition.

In the preferred embodiment, the internal construction of the present invention also includes a resilient heel insert which is disposed under the substantially planar portion of the platform, over a substantial portion of the heel region. The platform portion is provided with a platform attachment means that permits releasable engagement of one end of the elastic element to a selected portion of the platform. Similarly, the support frame is provided with a support frame attachment means that permits releasable engagement of the other end of the elastic element to a portion of the support frame. The spatial relationship of this attachment means is such that the elastic element extends from a point on the support frame over a length at least equal to the height at which the elastic element extends from the platform. In the illustrated embodiments, the elastic element extends between the platform and support frame along a direction defined between the heel region and forefoot region of the outer sole.

In a first embodiment of the present invention, the platform, support frame and elastic element are each realized as separately formed components. They are integrated between a conventional outer sole and inner sole to provide a shoe or other footwear assembly. In this embodiment, the support frame encircles a substantial portion of the heel region to provide additional structural support.

In a second embodiment of the present invention, a separately realized support frame is molded in the heel region of the outer sole, while the platform and elastic element are each realized as separate components integrated between a conventional outer sole and inner sole.

In a third embodiment, the support frame and an outer sole portion are integrally molded as a single unit, while the platform and elastic element are each realized as separate components integrated between the outer sole portion and inner sole.

In yet a fourth embodiment, the platform and support frame are integrally formed as a unitary mid-sole element, with a separately realized elastic element installed between the platform and support frame.

With alternative embodiments, the elastic element can be integrally co-molded with either or both the platform and support frame to form a unitary construction using conventional techniques known in the art.

The construction of the present invention has several significant advantages over the art-recognized designs. An elastic element having one set of energy absorbing-returning properties can be simply and quickly replaced with elements having different properties. This feature enables a pedestrian or athlete to adapt the footwear for a particular application by selectively changing the elastic element.

The internal construction of the present invention also provides comfort and cushioning for normal walking activity. But, it can readily provide biomechanical advantage during vigorous physical activity which may involve shock or physical impact to the foot.

BRIEF DESCRIPTION OF THE DRAWINGS

Reference is now made to the following detailed description of the preferred embodiments in connection with the accompanying drawings, wherein.

DETAILED DESCRIPTION OF ILLUSTRATIVE EMBODIMENTS

The internal footwear construction of the present invention is illustrated in several different footwear embodiments shown in FIGS. 1, 1A, 2, 2A, 3, 3A, 4 and 4A. Several components are employed with various geometrics and structural relationships. But, the fundamental detail and function of the internal footwear construction remain essentially the same. It is contemplated that the particular elements may vary from one embodiment to another and still perform the intended function of the present invention.

Figure 1:
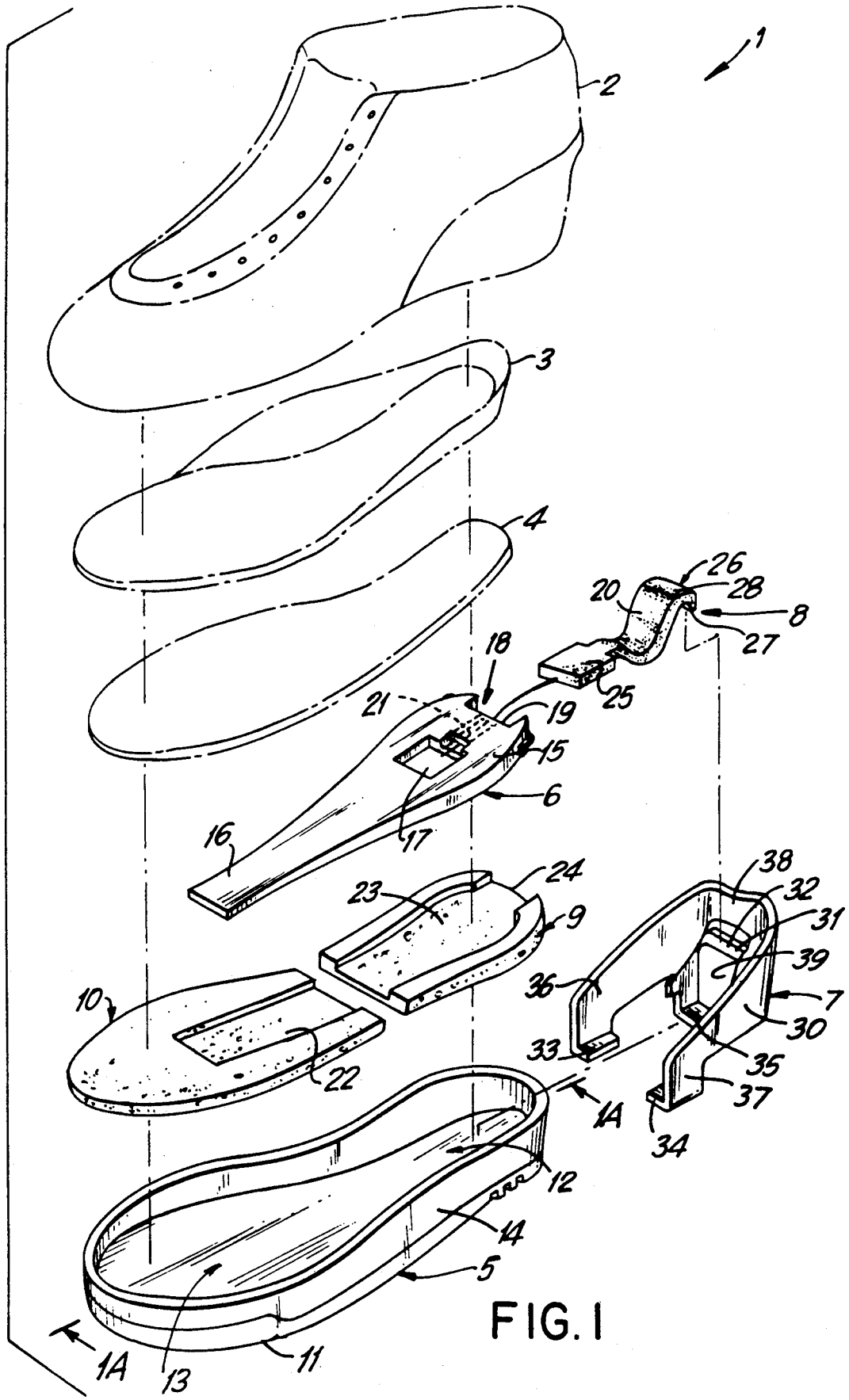
FIG. 1 is a perspective, exploded view of a shoe assembly showing a first embodiment of the internal footwear construction of the present invention.
Figure 1A:
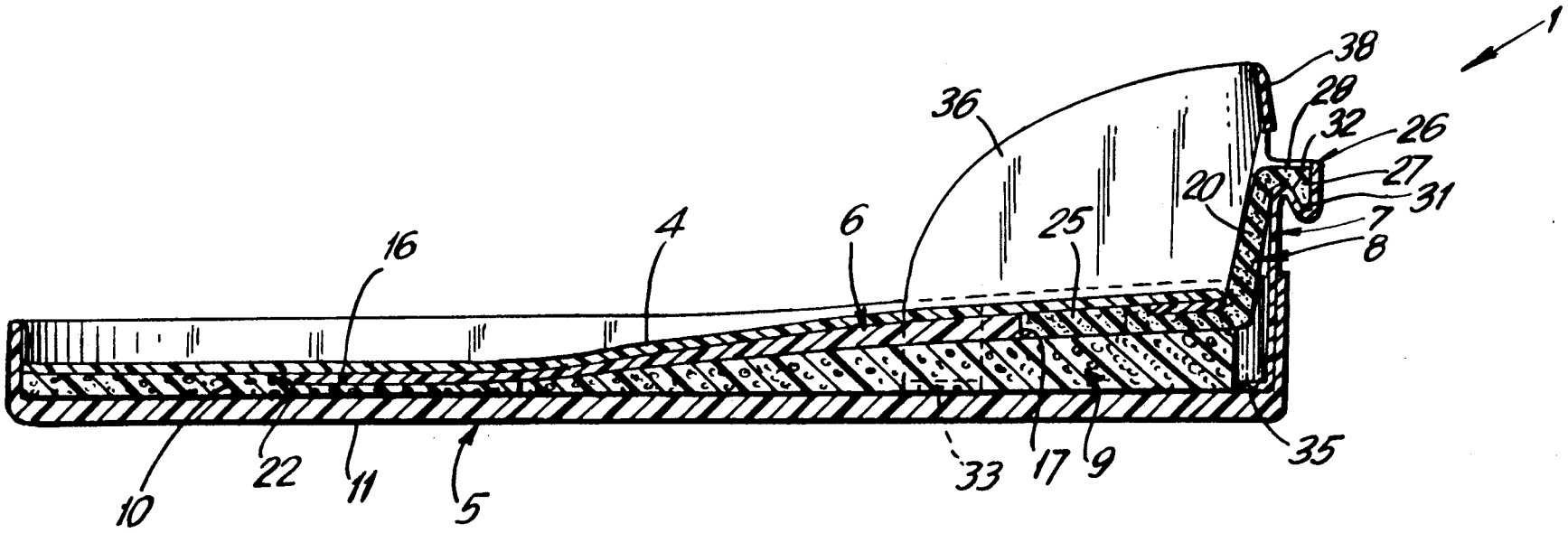
FIG. 1A is an elevated cross-sectional view taken along line 2—2 of FIG. 1, showing the internal footwear construction without user loading.

In FIGS. 1 and 1A, the internal footwear construction is shown (for illustration only) in connection with an athletic shoe, generally indicated by reference numeral 1. Shoe 1 may have a conventional upper 2, contoured inner sole 3, mid-sole cover layer 4 and outer sole 5. In general, the internal footwear construction comprises a substantially non-yielding platform 6, substantially non-yielding support frame 7 and elastic element 8. Resilient heel insert 9 and resilient forefoot platform locator 10 function as a mid-sole when taken together. As shown, the internal footwear construction is installed between contoured inner sole 3 and outer sole 4. In the other illustrative embodiments, similar components will be designated by using corresponding reference numerals.

As illustrated in FIGS. 1 and IA, outer sole 5 has an outer surface 11, heel region 12, forefoot region 13 and continuous side walls 14 about the perimeter of outer sole 5. Upper 2 is fastened to outer sole 5 in a conventional manner well known in the art. Contoured inner sole 3 is preferably made of a foamed plastic material. Inner sole 3 is placed on mid-sole cover layer 4, which can be made from plastic materials.

Platform 6 is substantially planar. Preferably, it has a thicker dimension above heel region 12 and tapers towards forefoot region 13 of outer sole 5. Portion 15 above heel region 12 is preferably wider than portion 16 about the forefoot region. Each dimension is selected to provide stable support to the heel portion of a user's foot. About portion 15 there is formed aperture 17 which functions as a platform attachment means for elastic element 8. At rear portion 18 of platform 6, recess 19 is formed to permit passage of mid-body portion 20 of elastic element 8, when all of the components are assembled together as shown in FIG. 1A. In addition, recessed channel 21 is formed in the underside of platform 6, between aperture 17 and rear recess 19. Recessed channel 21 is adapted to accommodate elastic element 8 and permit elongation and contraction when elastic element 8 is in the loaded and unloaded condition.

Platform locator 10 has surface recess 22 which conforms to the shape of tapered portion 16 of platform 6. Typically, platform locator 10 is attached to the forefoot region of inner sole 5 by an adhesive. Portion 16 of platform 6 is mounted within recess 22 using an adhesive or fastener to render the platform operably associated with platform locator 10 in a hingedly connected manner. Alternatively, platform 6 can be integrally formed or co-molded with platform locator 10 using known techniques. Heel insert 9 is mounted in the heel region of inner sole 5 as shown. In the illustrated embodiment, heel insert 9 is tapered, being thicker in its rear portion and thinner over its front portion. Like platform locator 10, heel insert 9 has surface recess 23 which conforms to portion 15 of platform 6. Surface recess 23 also extends into the rearmost portion of heel insert 9 to provide clearance 24 for elastic element 8 when the components of the footwear assembly are taken together.

Elastic element 8, which in some respects resembles a tendon, includes elongated body portion 20 having selected elastomeric properties. As illustrated, elastic element 8 is terminated in first and second end portions 25 and 26, respectively. First end portion 25 is realized as a rectangular-shaped portion having a height substantially equal to the thickness of platform portion 15 about aperture 17. Second end portion 26 has a generally U-shaped cross-section with endmost projection 27 having a trapezoidal geometry which extends downwardly away from planar portion 28. Elastic element 8 may be made from a wide variety of elastic materials. For any particular application, elastic element 8 will permit repeated elongation (i.e., elastic deformation) as it is cyclically loaded during normal walking or running activity.

As illustrated in FIGS. 1 and IA, support frame 7 has support wall 30 which extends in a generally U-shaped configuration. At the mid-portion of support wall 30, cavity 31 is particularly adapted for releasable engagement of second end 26 of elastic element 8. Cavity 31 is defined by an inner cavity wall and outer cavity wall and a pair of opposing side walls. These elements cooperate to form trapezoidal slot 32 which matches the general dimensions of trapezoidal projection 27 on elastic element 8. To provide a stable base for support frame 7, base flanges 33 and 34 extend perpendicularly from opposing side end portions 36 and 37 of support wall 30. In addition, the mid-rear portion 38 of support wall 30 is also provided with base flange 35 in a perpendicular manner.

Accommodating recess 39 is formed in the inner mid-portion of support wall 37. Recess 39 permits up and down movement of body portion 20 of elastic element 8 (relative to support frame 7) during cyclical loading of platform 6. The height contour of support wall 30 is preferably higher at rear portion 38 and lower at side perimeter portions 36 and 37. The various dimensions of support wall 30 provide structural support about heel region 12, an insure that second end 26 of elastic element 8 is sufficiently displaced above outer sole 5. Support frame 7 is preferably molded from a substantially non-yielding plastic, but other known materials can be used with equivalent results.

The components described above may be assembled in numerous ways. According to one method, support frame 7 is mounted into rear portion 12 of outer sole 5 using a conventional adhesive. Next, heel insert 9 is installed over heel region 12 and base flanges 34, 35 and 36 of support frame 7, again using a conventional adhesive. Platform locator 10 and platform 6 are fastened together, and rectangular portion 25 of elastic element 8 is placed in aperture 17 of platform 6 to form a sub-assembly. Platform locator 10 of the sub-assembly is installed over the forefoot region of outer sole 5 so that platform 6 rests within clearance 24. Projection 27 is then mounted in cavity 31 of support frame 7 as shown in FIG. 1. After insertion of mid-sole cover 4 and contoured inner sole 3, upper 2 can be attached to outer sole 5 in a conventional manner. Alternatively, components 3 and 4 can be fitted in place without adhesive.

The internal footwear construction can be separately used with a plurality of elastic elements having different elastomeric properties. Elastic element 8 can be color-coded or otherwise designated to facilitate identification and selection. In this way, an individual elastic element can be selected to accommodate a particular physical activity. Interchangeability is accomplished as follows.

Heel portions of contoured inner sole 3 and mid-sole cover 4 are pulled upwardly to reveal previously installed elastic element 8. Platform 6 is pulled upwardly and rectangular portion 25 of elastic element 8 is removed from aperture 17 and pulled away from platform 6 (i.e., under recess channel 21 . Elastic element 8 is completely removed by pulling trapezoidal projection 27 out of cavity 31. Elastic element 8 is replaced by pulling upwardly on the heel portions of contoured inner sole 3 and mid-sole cover 4; pulling upwardly on platform 6; feeding rectangular portion 25 of elastic element 8 under platform 6 (i.e., under recess channel 21); pushing rectangular portion 25 into aperture 17; releasing platform 6; pushing trapezoidal projection 27 of elastic element 8 into cavity 31; and releasing mid-sole cover 4 and contoured inner sole 3. After this procedure is complete, the internal footwear construction is ready for end-use application.

Figure 2:
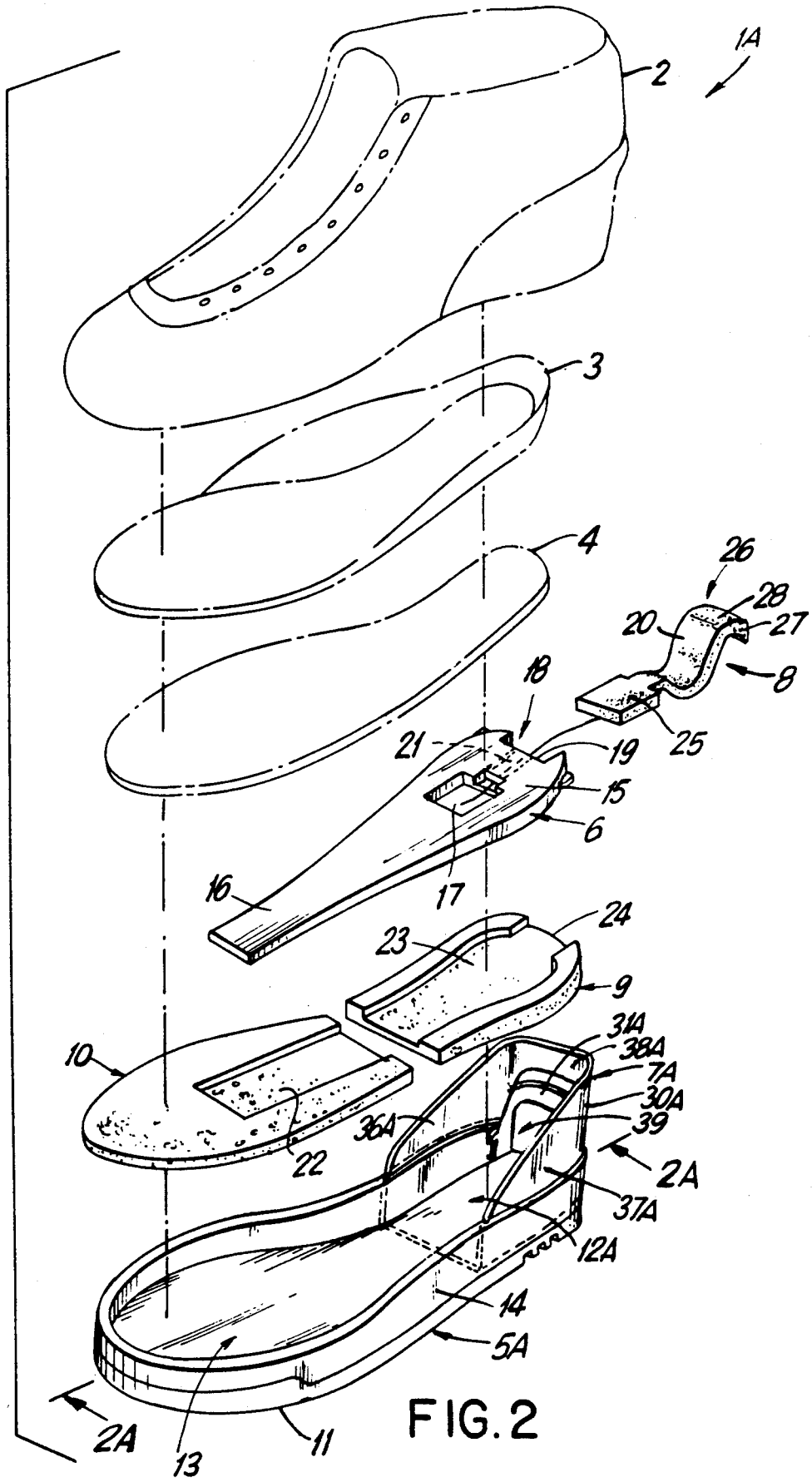
FIG. 2 is a perspective, exploded view of a shoe assembly showing a second embodiment of the internal footwear construction.
Figure 2A:
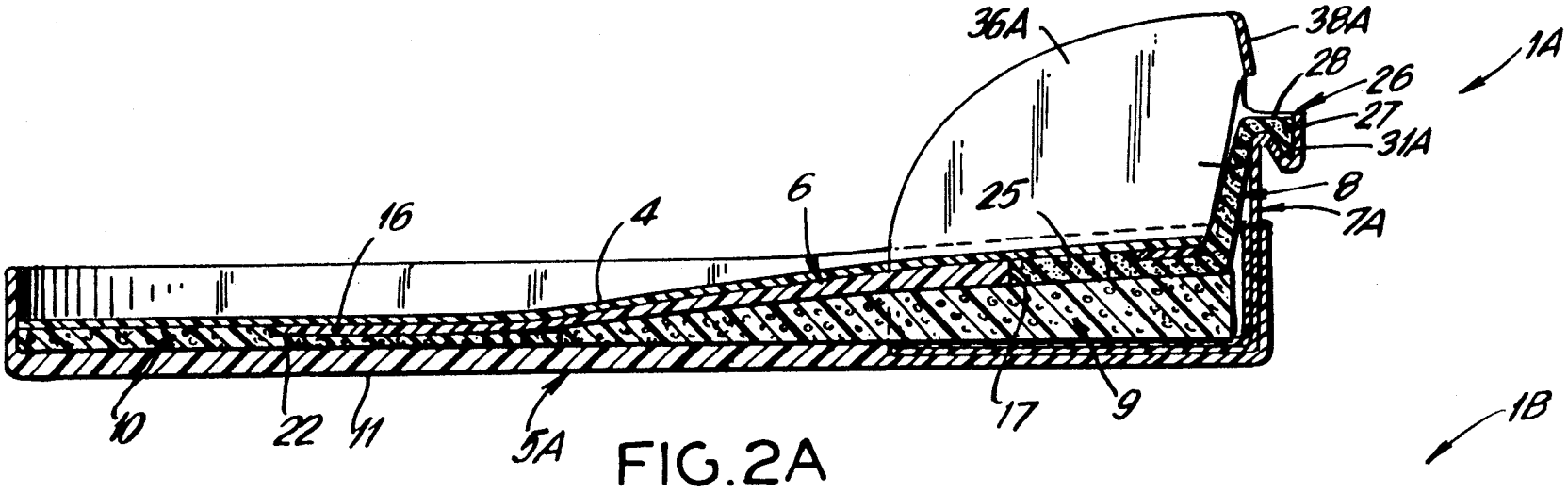
FIG. 2A is an elevated cross-sectional view taken along line 2A—2A of FIG. 2, showing the internal footwear construction without user loading.

In FIGS. 2 and 2A, there is shown a modified version of sports shoe 1, generally indicated as 1A. In sports shoe 1A, all components are identical with the exception of support frame 7A and outer sole 5A, which are designated by corresponding reference numerals. Rather than the support frame being adhesively or otherwise secured to heel region of the outer sole 5, support frame 7A is molded into the heel region of outer sole 5 by a conventional process. In certain footwear applications, this embodiment has several advantages, including greater strength, lower assembly costs and an integral exterior portion.

Figure 3A:
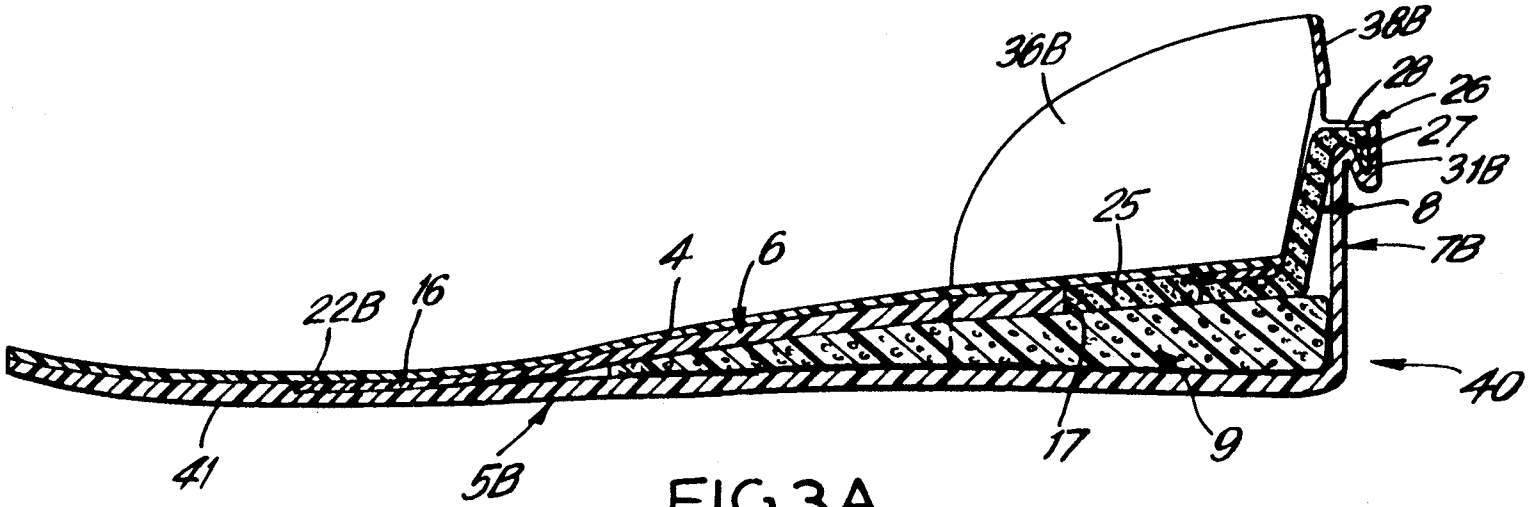
FIG. 3A is an elevated cross-sectional view taken along line 3A—3A of FIG. 3, showing the internal footwear construction without user loading.
Figure 3:
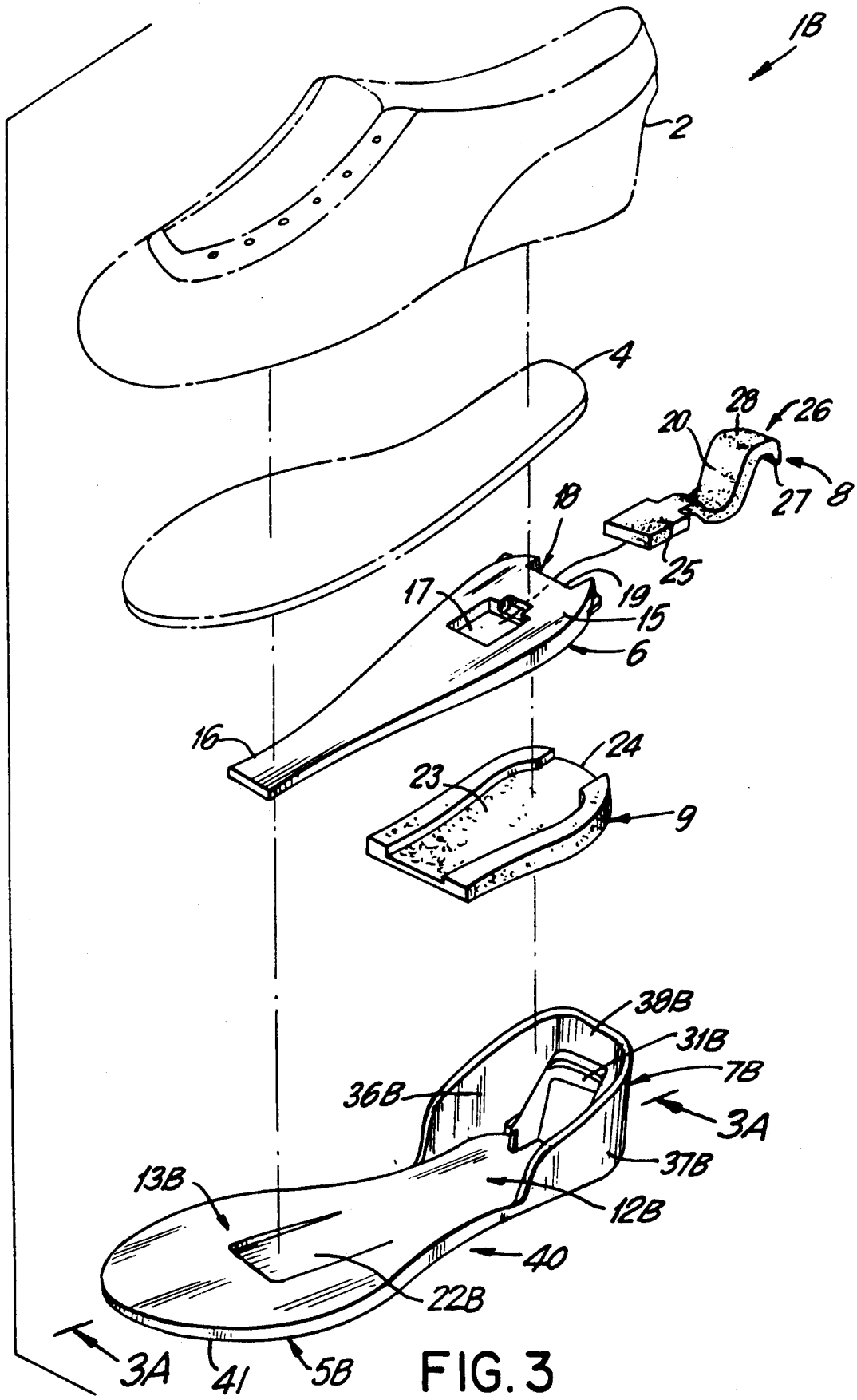
FIG. 3 is a perspective, exploded view of a shoe assembly showing a third embodiment of the internal footwear construction.

In FIGS. 3 and 3A, a third embodiment of the internal footwear construction is shown in another shoe assembly, generally indicated by reference number 1B. As shown, shoe 1B includes upper 2, inner sole 4, resilient heel insert 9 and outer sole and support frame unit 40. In general, unit 40 comprises an outer sole portion 5B and support frame portion 7B which are integrally formed as a single molded unit by known molding technology. Preferably, unit 40 is formed with conventional plastic materials well known in the art. Outer sole portion 5B has a heel region 12B, forefoot portion 13B, platform locator recess 22B and bottom surface 41 to receive an outer sole layer with a desired gripping surface (not shown). Support frame 7B includes all of the structural features of support frame 7, and these features are indicated by corresponding reference numerals.

The structure and function of platform 6, elastic element 8 and support frame portion 7B are similar to corresponding elements of the first and second embodiments. The previously described construction materials can also be used to realize the internal footwear construction shown in FIGS. 3 and 3A.

Footwear assembly IB can be achieved by mounting heel insert in heel region 12B of outer sole portion 5B, using a conventional adhesive. Then rectangular portion 25 of elastic element is placed in aperture 17 of platform 6 to form a sub-assembly. Tapered portion 16 of platform 6 is installed within platform locator recess 22B in forefoot region 13B of outer sole portion 5B. With portion 16 mounted in recess 22B, platform portion 19 above the heel region of outer sole 5B will lie within recess 23 formed in heel insert 9. Inner sole 4 is placed on platform 6 and forefoot region 13B of outer sole portion 5B. Upper 2 is fastened to outer sole portion 5B and support frame wall 30 in a conventional manner to complete the assembly process.

Figure 4:
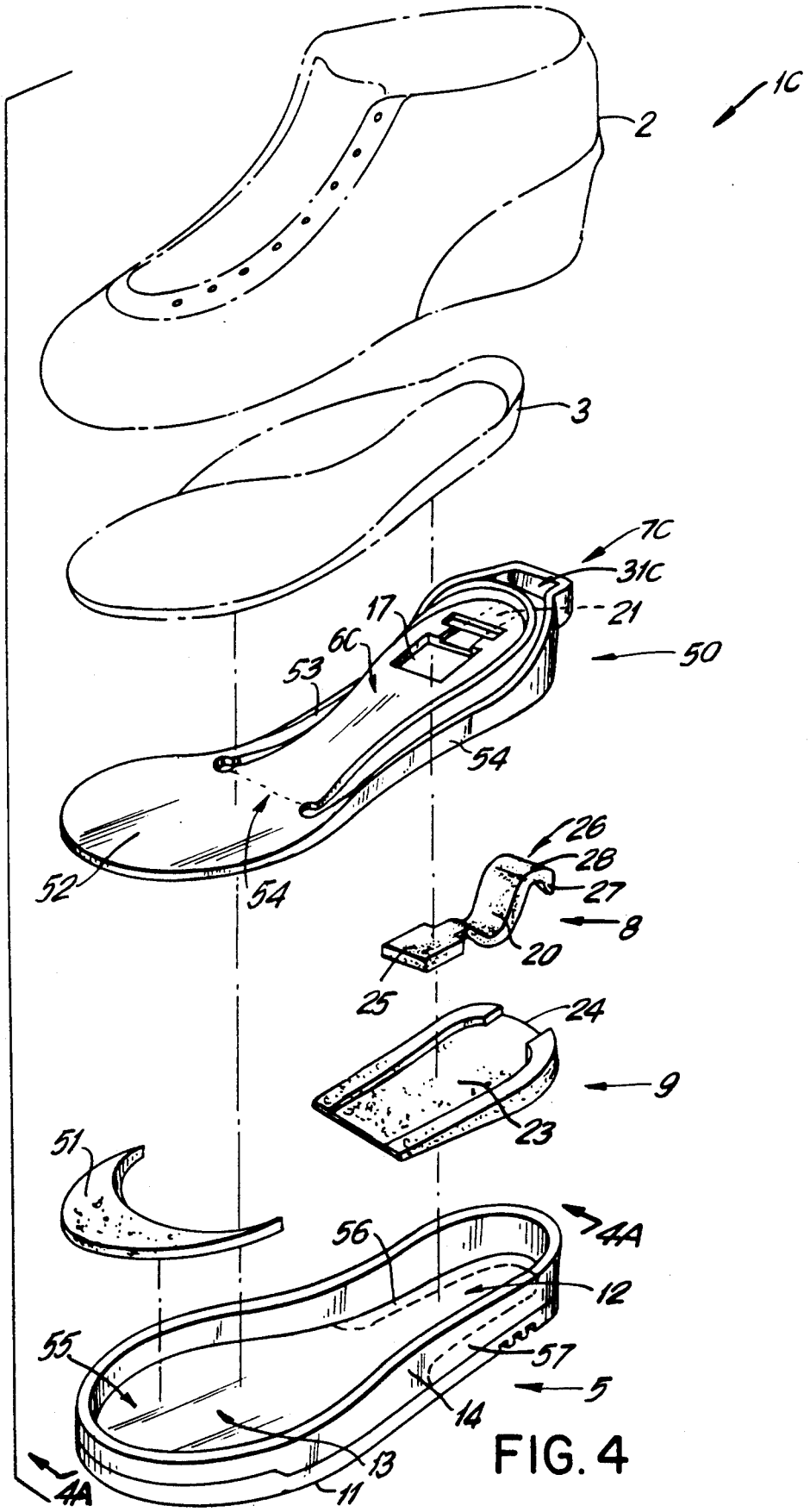
FIG. 4 is a perspective, exploded view of a shoe assembly showing a fourth embodiment of the internal footwear construction.
Figure 4A:
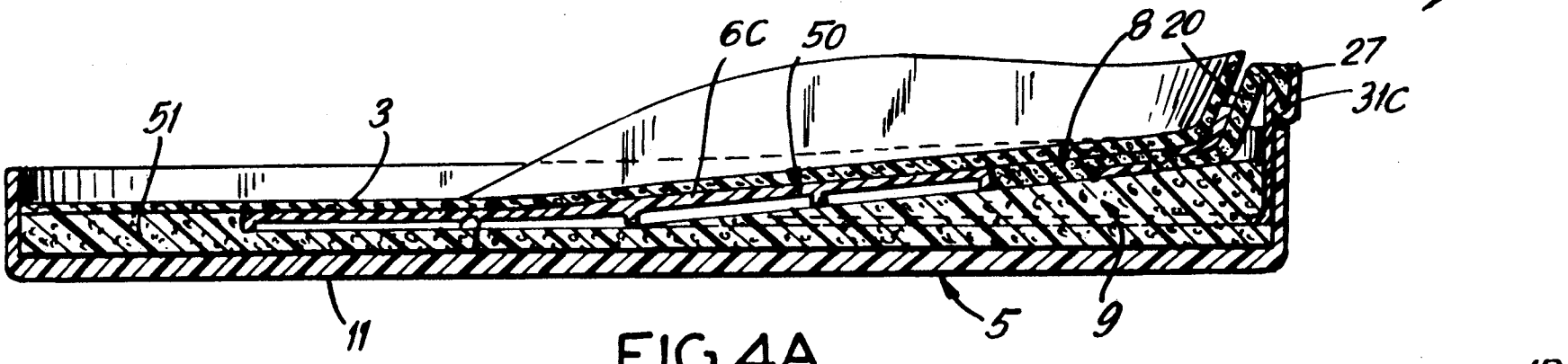
FIG. 4A is an elevated cross-sectional view taken along line 4A—4A of FIG. 4, showing the internal footwear construction without user loading.

Turning now to FIGS. 4 and 4A, a fourth embodiment of the internal footwear construction will be described with reference to another shoe assembly, generally indicated by reference numeral 1C. Shoe 1C includes upper 2, contoured inner sole 3, integrally formed mid-sole element 50, elastic element 8, resilient forefoot insert 51, heel insert 9 and outer sole 5. Forefoot insert 51 and heel insert 9, taken together, function as a mid-sole cushioning layer.

As illustrated in FIG. 4, integrally formed mid-sole element 50 includes forefoot portion 52 which continues into platform portion 6C having all of the structural features and characteristics of platform 6 illustrated in FIGS. 1, 1A, 2, 2A, 3 and 3A above. These structural features are again designated by corresponding reference numerals. Forefoot portion 52 also continues into a pair of peripheral elements 53 and 54 which straddle platform portion 6C at a predetermined distance below, and eventually continue into support frame 7C. Support frame 7C also has many of the structural features and characteristics of support frame 7 shown in FIGS. 1, 1A, 2, 2A, 3 and 3A. These features are therefore designated by corresponding reference numerals. As formed, the substantially planar support frame portion 6C is operably associated with forefoot portion 52 at intermediate region 54, and is capable of a modest degree of vertical flexing relative to forefoot portion 52. Integrally formed mid-sole element 50 is preferably molded from a suitable plastic.

Shoe assembly 1C can be achieved by installing heel insert 9 in heel region 12 of outer sole 5, and forefoot insert 51 in the foremost region 55 of outer sole 5. Conventional adhesive can be used to accomplish this procedure. Then integrally formed mid-sole element 50 is installed over forefoot region 13 and heel insert 9, and to inner perimeter surfaces 56 and 57 of forefoot region, using a conventional adhesive. In this installed configuration, platform portion 6C normally lies within recess 23 of heel insert 9, as illustrated in FIG. 4A. Platform portion 6C can be pulled away from recess 23 when desired. Contoured inner sole 3 is then placed over platform portion 6C and forefoot portion 52, and upper 2 is fastened to outer sole 5 in a conventional manner. To complete assembly of the internal footwear construction, elastic element 8 with selected characteristics is placed in shoe 1C by a procedure similar to that described above. When fully assembled, elastic element 8 extends between platform portion 6C and support frame 7C in a direction between heel region 12 and forefoot region 13 of outer sole 5.

Figure 5A:
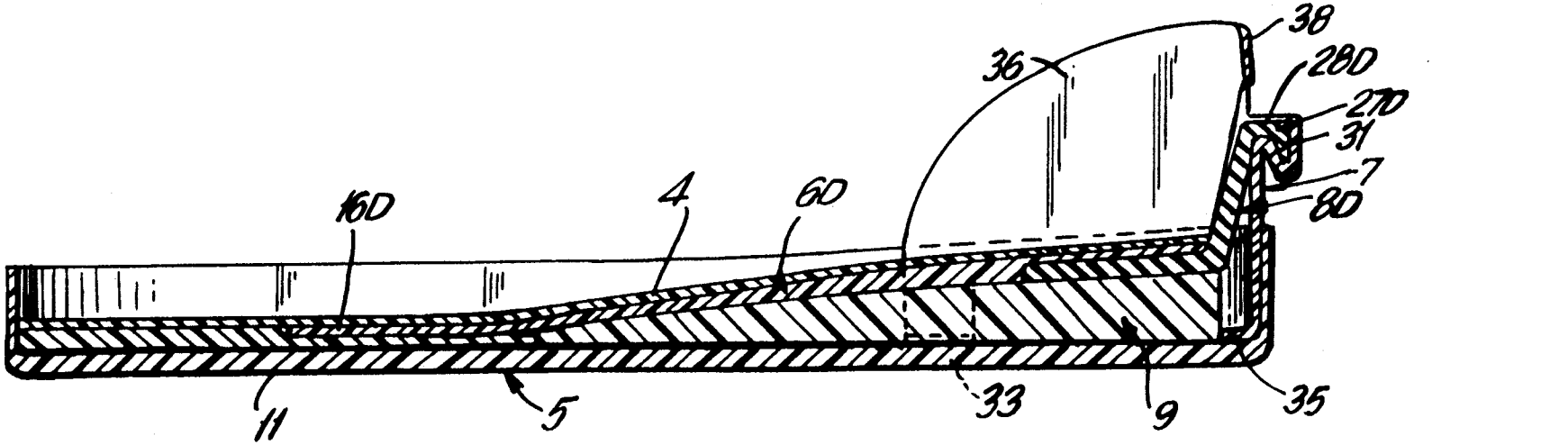
FIG. 5A is an elevated cross-sectional view taken along line 5A—5A of FIG. 5, showing the internal footwear construction without user loading.
Figure 5:
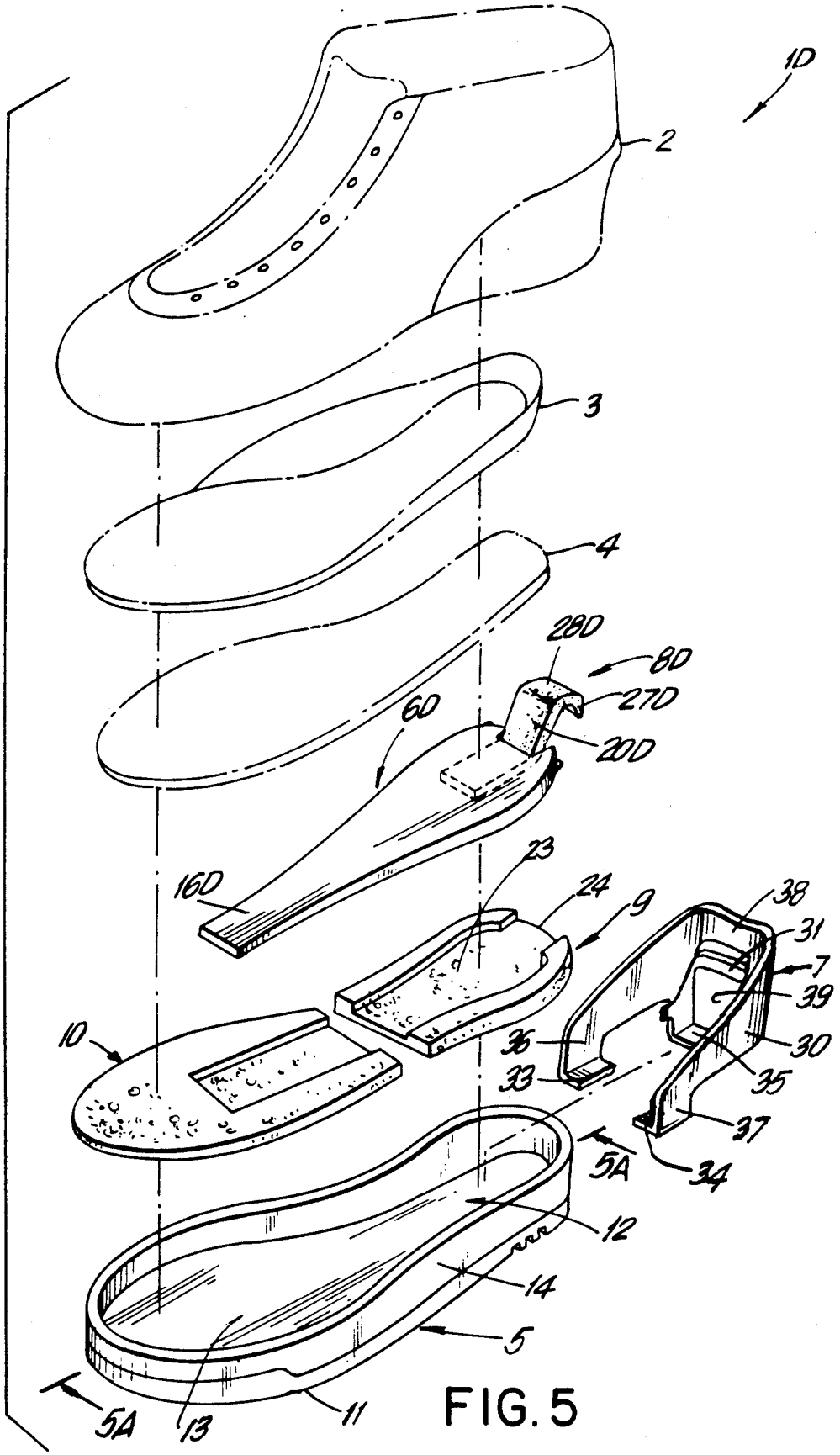
FIG. 5 is a perspective, exploded view of a shoe assembly showing a fifth embodiment of the internal footwear construction.

In the previously illustrated embodiments, elastic element 8 is separate from platform 6 and support frame 7. In FIGS. 5 and 5A, elastic element 8D is integrally formed with platform 6D using a conventional co-molding technique. Alternatively, elastic element 8D and platform 6D can be integrally formed with support frame 7.

Referring now to FIGS. 6A through 6D, the operation of the internal footwear construction of the present invention is illustrated over a series of foot movements, relative to a walking or running surface 60. Shoe 1 of FIGS. 1 and 1A has been selected for this illustration.

Figure 6A:
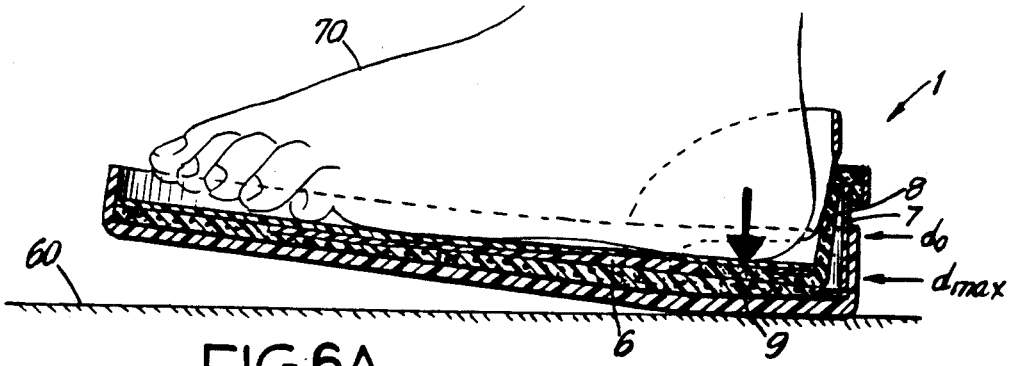
FIGS. 6A through 6D are schematic drawings which illustrate the operation of the internal footwear construction during a single step in the walking (running) process.

In FIG. 6A, the heel portion of shoe 1 impacts surface 60. In this position, the weight of an end-user is transmitted through the heel portion of foot 70 and against platform 6, as indicated by the reference arrow. This weight generated force displaces platform 6 downwardly, causing elastic element 8 to undergo elastic elongation. Elastic element 8 can absorb potential energy until the maximum downward platform displacement $d_{max}$ is attained. In this maximum energy storage state, resilient heel insert 9 will be substantially compressed as shown.

Figure 6B:
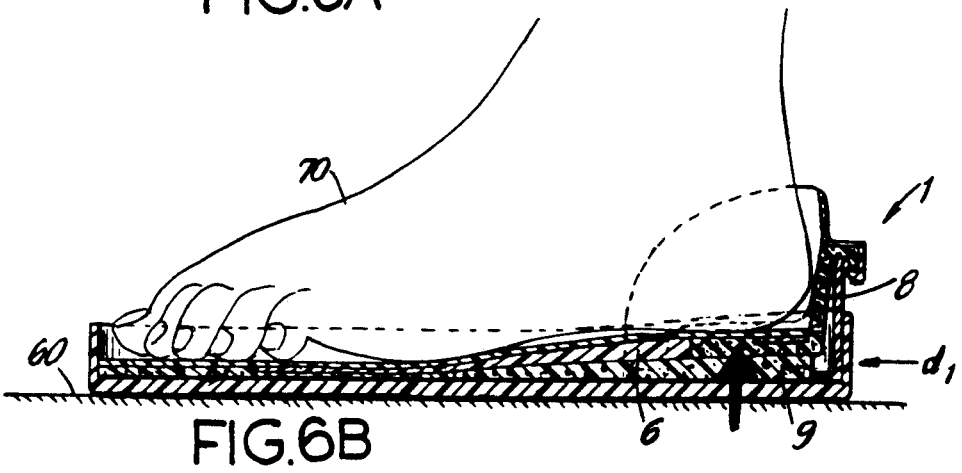
Figure 6C:
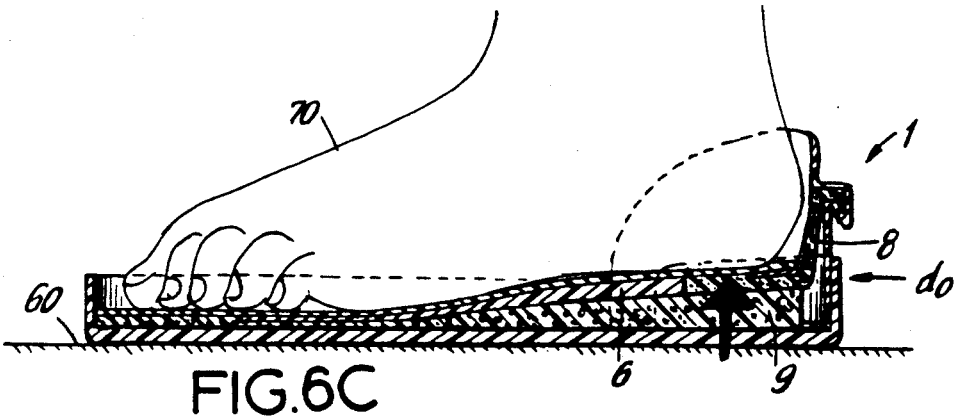
Figure 6D:
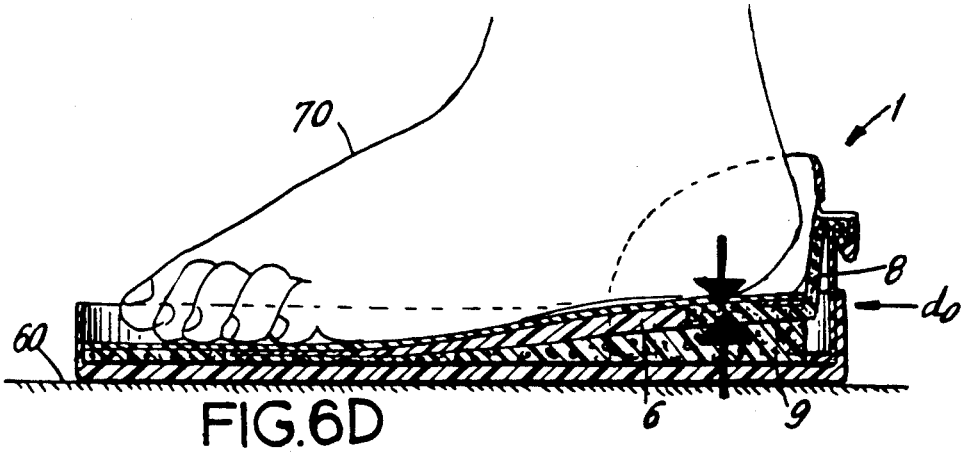

The energy return function is illustrated by FIGS. 6B and 6C. In FIG. 6B, the stored potential energy is transformed into the kinetic energy of platform 6, as elastic element 8 is permitted to return to its equilibrium state, shown in FIG. 6D. During these energy return stages, elastic element 8 continually exerts a restoring force which pulls upwardly on platform 6, indicated by the direction of the reference arrow. This restoring force provides a biomechanical advantage during the energy return operation performed by the internal footwear construction. The restoring force typically will be greatest at a point where platform 6 reaches displacement distance $d_{max}$ and begins to return to equilibrium position $d_o$, shown in FIG. 6A.

When platform 6 attains equilibrium position $d_o$, the restoring force of elastic element 8 is no longer present and the biomechanical advantage is suspended. With the forefront portion of shoe 1 in contact with surface 60, elastic element 8 reaches its equilibrium position and no biomechanical advantage is provided to the end-user.

The internal footwear construction described herein can be practiced with conventional techniques to improve support, comfort, physical integrity and biomechanical advantage. While the particular embodiments shown and described above have proven to be useful in many applications in the footwear art, further modifications of the present invention will occur to persons skilled in the art. All such modifications are within the scope of the present invention as defined by the claims that follow.

What is claimed is:

1. An internal construction for use in footwear including an outer sole having a heel region and a forefoot region, comprising:

a platform for providing support to a user's foot and extending from said forefoot region into at least a portion of said heel region and above said outer sole, said platform being displaceable relative to said outer sole and having a platform attachment means;

a support frame extending about a substantial portion of said heel region and extending substantially perpendicular to said outer sole, said support frame further including a support frame attachment means provided to an upper portion of said support frame;

a substantially planar forefoot portion disposed over at least a portion of said forefoot region, and a resilient heel insert disposed beneath at least a portion of said platform and over at least a portion of said heel region, said platform being substantially planar and connected to said substantially planar forefoot portion;

at least one elastic element extending between said platform and said support frame above said heel region, said elastic element extending from said support frame at a point on said support frame which is at least equal to the height at which said elastic element extends from said platform, said elastic element having first and second end portions and extending between said platform and said support frame along a direction defined between said heel region and said forefoot region of said outer sole, said platform attachment means including an aperture formed in said platform portion and said first end portion of said elastic element being releasably attached through said aperture, and said support frame attachment means having a cavity formed in said upper portion of said support frame and said second end portion of said elastic element being releasably attached to said cavity;

whereby said elastic element is permitted to undergo elongation in response to displacement of said platform toward said outer sole when force produced by the weight of said user's foot is applied against said platform.

2. The internal construction of claim 1, wherein said platform has an underside surface and a rear portion, and said platform further comprises a recess formed in the underside surface of said platform, between said aperture and said rear portion, for insertion of a portion of said elastic element.

3. The internal construction of claim 2, wherein said first end of said elastic element has a gross geometry and general dimensions which correspond with said aperture to permit releasable insertion of said first end into said aperture.

4. The internal construction of claim 3, wherein said second end of said elastic element includes a portion having a gross geometry and general dimensions which correspond with said cavity to permit releasable insertion of said portion into said cavity.

5. An internal construction for use in footwear including an outer sole having a heel region and a forefoot region, comprising:

a platform having a substantially planar portion and continuing into a heel support portion for providing support to a user's foot, said platform extending from said forefoot region into at least a portion of said heel region and above said outer sole, said platform being displaceable relative to said outer sole and having a platform attachment means;

a support frame extending about a substantial portion of said heel region and extending substantially perpendicular to said outer sole, said support frame further including a support frame attachment means provided to an upper portion of said support frame;

at least one elastic element extending between said platform and said support frame above said heel region, said elastic element extending from said support frame at a point on said support frame which is at least equal to the height at which said elastic element extends from said platform, said elastic element having first and second end portions and extending between said platform and said support frame along a direction defined between said heel region and said forefoot region of said outer sole;

said platform attachment means including an aperture formed in said platform portion and said first end of said elastic element being releasably attached through said aperture, and said support frame attachment means having a cavity formed in said upper portion of said support frame and said second end of said elastic element being releasably attached to said cavity;

whereby said elastic element is permitted to undergo elastic elongation in response to displacement of said platform toward said outer sole when force produced by the weight of the user's foot is applied against said platform.

6. The internal construction of claim 5, wherein said platform has a substantially planar portion which continues into a heel support portion and extends over at least a portion of said heel region.

7. The internal construction of claim 6, wherein said platform has an underside surface and a rear portion, and said platform further comprises a recess formed in the underside surface of said platform, between said aperture and said rear portion, for insertion of a portion of said elastic element.

8. The internal construction of claim 7, wherein said first end of said elastic element has a gross geometry and general dimensions which correspond with said aperture to permit releasable insertion of said first end into said aperture.

9. The internal construction of claim 8, wherein said second end of said elastic element includes a portion having a gross geometry and general dimensions which correspond with said cavity to permit releasable insertion of said portion into said cavity.

10. An internal construction for use in footwear including an outer sole having a heel region and a forefoot region, comprising:

a platform for providing support to a user's foot and extending from said forefoot region into at least a portion of said heel region and above said outer sole, said platform being displaceable relative to said outer sole and having a platform attachment means;

a support frame formed as a projection of said outer sole and including a support frame attachment means provided to an upper portion of said support frame, said support frame extending about a substantial portion of said heel region and extending substantially perpendicular to said outer sole;

at least one elastic element extending between said platform and said support frame above said heel region, said elastic element having first and second portions and extending between said platform and said support frame along a direction defined between said heel region and said forefoot region of said outer sole, said elastic element extending from said support frame at a point on said support frame which is at least equal to the height at which said elastic element extends from said platform;

said platform attachment means including an aperture formed in said platform portion and said first end portion of said elastic element being releasably attached through said aperture, and said support frame attachment means having a cavity formed in said upper portion of said support frame and said second end portion of said elastic element being releasably attached to said cavity;

whereby said elastic element is permitted to undergo elongation in response to displacement of said platform toward said outer sole when force produced by the weight of the user's foot is applied against said platform.

11. An internal construction for use in footwear including an outer sole having a heel region and a forefoot region, comprising:

a platform for providing support to a user's foot and extending from said forefoot region into at least a portion of said heel region and above said outer sole, said platform being displaceable relative to said outer sole and having a platform attachment means;

a support frame formed as a portion of and connected to a mid-sole element, said support frame extending about a substantial portion of said heel region and extending substantially perpendicular to said outer sole, said support frame further including a support frame attachment means provided to an upper portion of said support frame;

at least one elastic element extending between said platform and said support frame above said heel region, said elastic element having first and second end portions and extending between said platform and said support frame along a direction defined between said heel region and said forefoot region of said outer sole, said elastic element extending from said support frame at a point on said support frame which is at least equal to the height at which said elastic element extends from said platform;

said platform attachment means including an aperture formed in said platform portion and said first end portion of said elastic element being releasably attached through said aperture, and said support frame attachment means having a cavity formed in said upper portion of said support frame and said second end portion of said elastic element being releasably attached to said cavity;

whereby said elastic element is permitted to undergo elongation in response to displacement of said platform toward said outer sole when force produced by the weight of the user's foot is applied against said platform.

* * * * *

UNITED STATES PATENT AND TRADEMARK OFFICE

CERTIFICATE OF CORRECTION

PATENT NO. : 5,187,883

DATED : February 23, 1993

INVENTOR(S) : Richard Penney

It is certified that error appears in the above-identified patent and that said Letters Patent is hereby corrected as shown below:

Column 3, line 15, delete "2-2" and insert --1A-1A--.

Column 4, line 2, delete "4" and insert --5--.

Column 5, line 14, delete "37" and insert --30--.

Column 6, line 9, delete "5" and insert --5A--.

Column 6, line 43, delete "19" and insert --15--.

Signed and Sealed this

Twelfth Day of April, 1994

Bruce Lehman

BRUCE LEHMAN

*Commissioner of Patents and Trademarks*

*Attest:*

*Attesting Officer*